US010065084B2

(12) United States Patent
Myrhum et al.

(10) Patent No.: US 10,065,084 B2
(45) Date of Patent: Sep. 4, 2018

(54) MULTI-MATERIAL GOLF CLUB HEAD

(71) Applicant: Acushnet Company, Fairhaven, MA (US)

(72) Inventors: Mark C. Myrhum, Del Mar, CA (US); Uday V. Deshmukh, Carlsbad, CA (US); Richard L. Cleghorn, Oceanside, CA (US); Nick Frame, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 273 days.

(21) Appl. No.: 14/945,243

(22) Filed: Nov. 18, 2015

(65) Prior Publication Data

US 2017/0136314 A1 May 18, 2017

(51) Int. Cl.

| | |
|---|---|
| ***A63B 53/04*** | (2015.01) |
| ***A63B 60/52*** | (2015.01) |
| ***A63B 60/50*** | (2015.01) |
| *A63B 60/00* | (2015.01) |

(52) U.S. Cl.

CPC ..... *A63B 53/0466* (2013.01); *A63B 60/50* (2015.10); *A63B 60/52* (2015.10); *A63B 2053/0408* (2013.01); *A63B 2053/0433* (2013.01); *A63B 2053/0437* (2013.01); *A63B 2060/002* (2015.10); *A63B 2209/00* (2013.01); *A63B 2209/02* (2013.01)

(58) Field of Classification Search

USPC ..... 473/345, 346, 349

See application file for complete search history.

(56) References Cited

U.S. PATENT DOCUMENTS

| | | | |
|---|---|---|---|
| 4,076,254 | A | 2/1978 | Nygren |
| 4,139,196 | A | 2/1979 | Riley |
| 4,229,550 | A | 10/1980 | Jones et al. |
| 4,448,941 | A | 5/1984 | Cheung et al. |
| 4,681,322 | A | 7/1987 | Straza et al. |
| 5,058,895 | A | 10/1991 | Igarashi |
| 5,132,178 | A | 7/1992 | Chyung et al. |
| 5,163,682 | A | 11/1992 | Schmidt et al. |
| 5,238,529 | A | 8/1993 | Douglas |

(Continued)

FOREIGN PATENT DOCUMENTS

| | | |
|---|---|---|
| GB | 2450764 | 7/2009 |
| JP | H05-7261 | 2/1993 |

(Continued)

OTHER PUBLICATIONS

The Royal and Ancient Golf Club of St. Andrews and USGA, Technical Description of the Pendulum Test revised version, Nov. 2003.

(Continued)

*Primary Examiner* — Nini Legesse

(74) *Attorney, Agent, or Firm* — Randy K. Chang

(57) ABSTRACT

A golf club head made out of multi-material is disclosed herein. More specifically, the golf club head in accordance with the present invention has at least a portion of the body of the golf club head that is further comprised out of a base layer and a lightweight cover layer. The base layer may have a plurality of cutouts to help reduce unnecessary mass and the lightweight cover layer may be made out of an ultra-lightweight material to further reduce the unnecessary mass.

18 Claims, 10 Drawing Sheets

(56) References Cited

U.S. PATENT DOCUMENTS

| | | | | |
|---|---|---|---|---|
| 5,295,689 | A | 3/1994 | Lundberg | |
| 5,310,185 | A | 5/1994 | Viollaz et al. | |
| 5,346,216 | A | 9/1994 | Aizawa | |
| 5,358,249 | A | 10/1994 | Mendralla | |
| 5,362,055 | A | 11/1994 | Rennie | |
| 5,380,010 | A | 1/1995 | Werner | |
| 5,403,007 | A | 4/1995 | Chen | |
| 5,405,136 | A | 4/1995 | Hardman | |
| 5,425,538 | A | 6/1995 | Vincent et al. | |
| 5,499,814 | A | 3/1996 | Lu | |
| 5,524,331 | A | 6/1996 | Pond | |
| 5,547,427 | A | 8/1996 | Rigal | |
| 5,570,886 | A | 11/1996 | Rigal | |
| 5,624,331 | A * | 4/1997 | Lo | A63B 53/0466 473/345 |
| 5,720,673 | A | 2/1998 | Anderson | |
| 5,743,813 | A | 4/1998 | Chen et al. | |
| 5,839,975 | A | 11/1998 | Lundberg | |
| 5,967,903 | A | 10/1999 | Cheng | |
| 5,997,415 | A | 12/1999 | Wood | |
| 6,152,833 | A | 1/2000 | Werner | |
| 6,440,008 | B2 | 8/2002 | Murphy et al. | |
| 6,533,681 | B2 | 3/2003 | Inoue et al. | |
| 6,558,271 | B1 | 5/2003 | Beach | |
| 6,605,007 | B1 | 8/2003 | Bissonnette et al. | |
| 6,617,013 | B2 | 9/2003 | Morrison et al. | |
| 6,623,543 | B1 | 9/2003 | Zeller et al. | |
| 6,837,094 | B2 | 1/2005 | Pringle et al. | |
| 6,860,824 | B2 | 3/2005 | Evans | |
| 6,945,876 | B2 | 9/2005 | Nakahara et al. | |
| 7,037,214 | B2 | 5/2006 | Nakahara et al. | |
| 7,056,229 | B2 | 6/2006 | Chen | |
| 7,074,136 | B2 | 7/2006 | Noguchi et al. | |
| 7,108,614 | B2 * | 9/2006 | Lo | A63B 53/0466 473/345 |
| 7,140,974 | B2 | 11/2006 | Chao et al. | |
| 7,258,624 | B2 * | 8/2007 | Kobayashi | A63B 53/04 473/324 |
| 7,267,620 | B2 | 9/2007 | Chao et al. | |
| 7,281,991 | B2 | 10/2007 | Gilbert et al. | |
| 7,281,994 | B2 | 10/2007 | De Shiell et al. | |
| 7,331,877 | B2 | 2/2008 | Yamaguchi et al. | |
| 7,347,796 | B2 | 3/2008 | Takeda | |
| 7,361,100 | B1 | 4/2008 | Morales | |
| 7,422,528 | B2 | 9/2008 | Gibbs et al. | |
| 7,448,964 | B2 | 11/2008 | Schweigert | |
| 7,510,485 | B2 | 3/2009 | Yamamoto | |
| 7,510,486 | B2 | 3/2009 | Werner | |
| 7,628,712 | B2 | 12/2009 | Chao et al. | |
| 7,632,193 | B2 | 12/2009 | Thielen | |
| 7,632,195 | B2 | 12/2009 | Jorgensen | |
| 7,686,708 | B2 | 3/2010 | Morales | |
| 7,798,203 | B2 | 9/2010 | Schweigert | |
| 7,861,395 | B2 | 1/2011 | Jorgensen | |
| 7,867,612 | B2 | 1/2011 | Schwung et al. | |
| 7,931,546 | B2 | 4/2011 | Bennett et al. | |
| 7,993,216 | B2 * | 8/2011 | Lee | A63B 53/0466 473/334 |
| 8,096,896 | B2 * | 1/2012 | De Schiell | A63B 53/0466 473/342 |
| 8,172,697 | B2 * | 5/2012 | Cackett | A63B 53/0466 473/329 |
| 8,221,261 | B2 | 7/2012 | Curtis et al. | |
| 8,247,062 | B2 | 8/2012 | Morrison et al. | |
| 8,293,356 | B2 | 10/2012 | Merrill et al. | |
| 8,419,569 | B2 | 4/2013 | Bennett et al. | |
| 8,475,292 | B2 | 7/2013 | Rahrig et al. | |
| 8,496,542 | B2 | 7/2013 | Curtis et al. | |
| 8,517,859 | B2 | 8/2013 | Golden et al. | |
| 8,540,590 | B2 | 9/2013 | Tsukada et al. | |
| 8,597,139 | B2 | 12/2013 | Jorgensen | |
| 8,715,109 | B2 | 5/2014 | Bennett et al. | |
| 8,758,161 | B2 | 6/2014 | Golden et al. | |
| 8,777,778 | B2 * | 7/2014 | Solheim | A63B 53/0466 473/345 |
| 8,790,196 | B2 * | 7/2014 | Solheim | A63B 53/0466 473/344 |
| 8,814,723 | B2 | 8/2014 | Tavares et al. | |
| 8,864,602 | B2 | 10/2014 | Curtis et al. | |
| 8,876,629 | B2 | 11/2014 | Deshmukh et al. | |
| 9,079,078 | B2 | 7/2015 | Greensmith et al. | |
| 9,079,089 | B2 | 7/2015 | Lokken et al. | |
| 9,079,368 | B2 | 7/2015 | Tavares et al. | |
| 9,101,811 | B1 | 8/2015 | Goudarzi et al. | |
| 2004/0192468 | A1 | 9/2004 | Onoda | |
| 2005/0096154 | A1 | 5/2005 | Chen | |
| 2005/0143189 | A1 * | 6/2005 | Lai | A63B 53/0466 473/335 |
| 2009/0088272 | A1 | 4/2009 | Foster et al. | |
| 2009/0092831 | A1 | 4/2009 | Stusgen et al. | |
| 2012/0142451 | A1 | 6/2012 | De Shiell | |
| 2013/0252757 | A1 | 9/2013 | Deshmukh et al. | |
| 2014/0057737 | A1 * | 2/2014 | Solheim | A63B 53/0466 473/345 |
| 2014/0106897 | A1 | 4/2014 | Golden et al. | |
| 2014/0329616 | A1 * | 11/2014 | Stokke | A63B 53/0466 473/346 |
| 2015/0108681 | A1 | 4/2015 | Deshmukh et al. | |
| 2015/0290503 | A1 | 10/2015 | Su | |
| 2015/0298196 | A1 | 10/2015 | Su | |

FOREIGN PATENT DOCUMENTS

| | | |
|---|---|---|
| JP | 2004-159794 | 6/2004 |
| JP | 2004-208728 | 7/2004 |
| JP | 2005-058461 | 3/2005 |
| JP | 2005-323686 | 11/2005 |
| JP | 2005-329154 | 12/2005 |
| JP | 2005-348895 | 12/2005 |
| JP | 2006-020860 | 1/2006 |
| JP | 2009-011839 | 1/2009 |
| JP | 2014-501167 | 1/2014 |

OTHER PUBLICATIONS

Machine Translation of JPH05-7261.

* cited by examiner

MULTI-MATERIAL GOLF CLUB HEAD

FIELD OF THE INVENTION

The present invention relates generally to an improved golf club head wherein a portion of the golf club head is made out of a multi-layered lightweight material. Using this lightweight material at different portions of the golf club head allows more discretionary mass to be created, which can be used to further improve the performance of the golf club by manipulating the center of gravity and moment of inertia of the golf club head.

BACKGROUND OF THE INVENTION

It is generally understood in the industry that the performance of a golf club head is largely dependent on the location of the Center of Gravity (CG) and Moment of Inertia (MOI) of the golf club head. In order to adjust the CG and MOI of a golf club head, golf club designers often strategically place mass at specific locations within the golf club head to achieve the desired CG and MOI. Pursuant to the design objective above, golf club designers have constantly struggled with way to reduce unnecessary mass from various portions of the golf club in order to strategically place it at more desirable portions. This process is so important to the design of a golf clubs; the golf club design industry even has a specific term used to describe this type of mass savings, called "discretionary mass".

U.S. Pat. No. 6,152,833 to Werner et al. illustrates one of the earlier examples of trying to create more discretionary mass by creating a lightweight low density striking face that is supported to its rear by a hollow shell structure.

U.S. Pat. No. 6,860,824 to Evans illustrates another example of golf club designers attempt in creating more discretionary mass. In U.S. Pat. No. 6,860,824 it is contemplated that a golf club head has a body portion that is preferably composed of a lightweight non-metallic material to help reduce mass from the body portion of the golf club head.

U.S. Pat. No. 5,624,331 to Lo et al. illustrates another example of increasing discretionary mass by creating a composite-metal wood-style golf club head having a metal casing with at least two opening in the crown in which composite covers are disposed.

Finally, U.S. Pat. No. 7,361,100 to Morales et al. illustrates a modern day example of utilizing modern day materials to increase the discretionary mass within a golf club. More specifically, U.S. Pat. No. 7,361,100 discloses a golf club head that is formed with a crown having an aperture with an arcuate rear edge and a forward edge that is substantially parallel to the striking face, wherein the opening formed in the aperture by the ribs are filled with an organic-composite material such as carbon fiber epoxy.

It should be noted that although all of the above referenced prior art are very capable of reducing unnecessary mass from various portions of the golf club head, it fails to address the ancillary drawback associated with the usage of lightweight materials such as graphite composite. When lightweight materials are used to replace metallic materials at various portions of the golf club, the sound and feel of the golf club can significantly degrade, resulting in a undesirable golf club. Hence it can be seen from the above that although the current art is capable of creating discretionary mass by using lightweight materials, it fails to do so while minimizing the undesirable sound and feel of the golf club.

BRIEF SUMMARY OF THE INVENTION

One aspect of the present invention is a golf club head comprising of a striking face portion located at a frontal portion of said golf club head and a body portion attached to an aft portion of said striking face portion further comprising a crown portion and a sole portion. The golf club head has at least one of the crown portion and the sole portion further comprising of a base layer and a lightweight cover layer, wherein the base layer further comprises a plurality of cutouts and the lightweight cover layer has an Internal Exposure Percentage of greater than about 15% to about 60%.

In another aspect of the present invention, a golf club head comprising of a striking face portion located at a frontal portion of said golf club head and a body portion attached to an aft portion of said striking face portion further comprising a crown portion and a sole portion. The golf club head has at least one of the crown portion and the sole portion further comprising of a base layer and a lightweight cover layer, wherein the base layer further comprises a plurality of cutouts and the lightweight cover layer has an Internal Exposure Percentage of greater than about 15% to about 60%, and the base layer has a maximum thickness of less than about 0.50 mm and the lightweight cover layer has a maximum thickness of less than about 0.30 mm.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
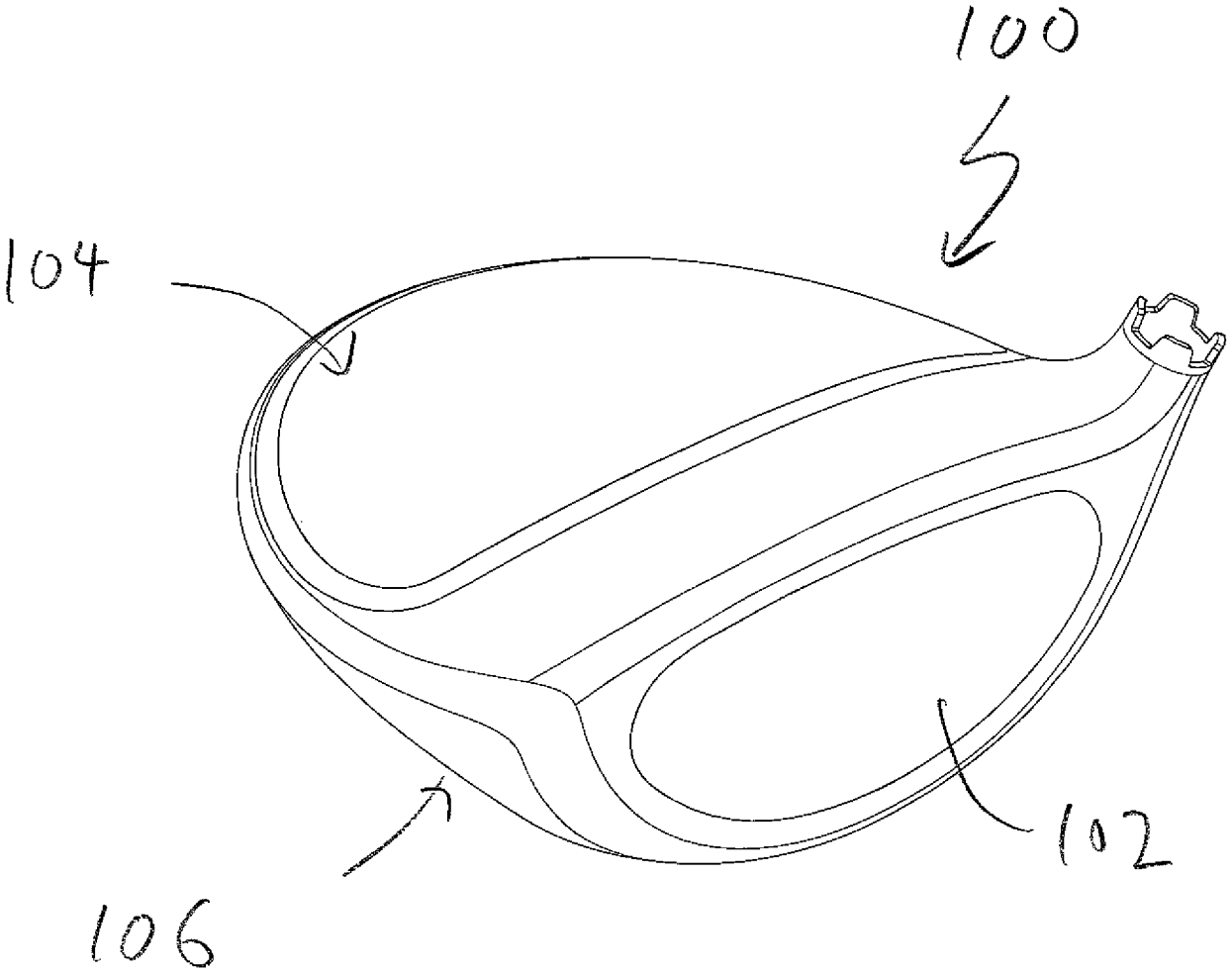
FIG. 1 of the accompanying drawings shows a perspective view of a golf club head in accordance with a preferred exemplary embodiment of the present invention.

FIG. 1 shows a perspective view of a golf club head 100 in accordance with an exemplary embodiment of the present invention. Golf club head 100 shown in FIG. 1 may generally have a striking face 102 attached to a frontal portion of the golf club head 100 and a body portion attached to an aft portion of the striking face 102. The body portion may generally be further comprised of a crown portion 104 near a top of the golf club head 100 and a sole portion 106 located near a bottom of the golf club head 100. Finally, and most importantly, the crown portion 104 of the golf club head 100 in accordance with the exemplary embodiment of the present invention may be further comprised out of multiple layers that have different materials. Alternatively speaking, it can be said that the golf club head 100 in accordance with an exemplary embodiment of the present invention may have a multi-material crown.

Figure 2:
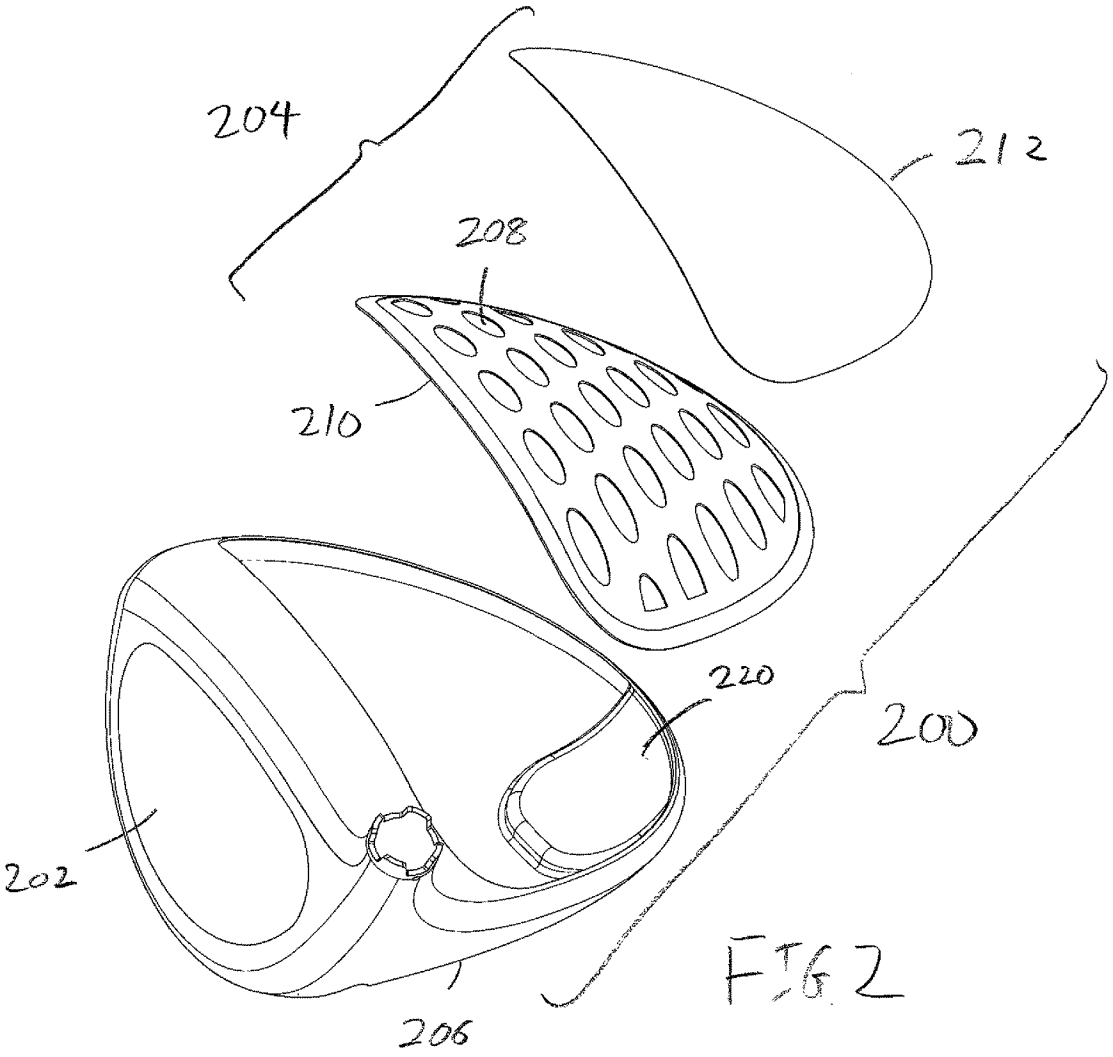
FIG. 2 of the accompanying drawings shows an exploded perspective view of a golf club head in accordance with the embodiment of the present invention shown in FIG. 1.

In order to provide a more clear illustration of the various components of the golf club head 100 in accordance with this exemplary embodiment of the present invention FIG. 2 is provided herein. FIG. 2 shows an exploded perspective view of a golf club head 200 illustrating that the multi-material crown portion 204 may be further comprised out of a base layer 210 and a lightweight cover layer 212.

The base layer 210 may generally be comprised out of a titanium type material with a density of between 4.0 g/cm$^3$ and about 4.7 g/cm$^3$, more preferably between about 4.1 g/cm$^3$ and about 4.6 g/cm$^3$, and most preferably about 4.4 g/cm$^3$. This titanium base layer 210 not only serves to help provide structural rigidity to the crown portion 204 of the golf club head 200, but can also help contribute to the generation of discretionary mass by incorporating a plurality of cutouts 208 across the entire area. The plurality of cutouts 208 shown in this exemplary embodiment of the present invention may generally be oval or circular shaped in order to provide the most mass savings all while preserving the structural integrity of the base layer 210. However, it should be noted that although the oval or circular shaped cutouts 208 are preferred, many other types of cutout 208 geometry can be used to remove material from the base layer 210 without departing from the scope and content of the present invention.

When holes are cut out from a material, it is generally understood that the structural rigidity of the material may suffer. Hence, in order to address the potential degradation of the structural rigidity in the crown portion 204 due to the plurality of cutouts 208, the present invention may utilize a combination of different technologies. First and foremost, the present invention attempts to recapture some of the lost structural rigidity by utilizing a higher strength titanium material for the base layer 210. In one preferred embodiment of the present invention ATI 425 Titanium material is used; however, numerous other high strength material such as SP 700 Titanium, KS 120 Titanium, KS 100 Titanium, Titanium 8-1-1- may all be used without departing from the scope and content of the present invention so long as it provides an elevated strength performance. In addition to the utilization of a high strength titanium material for the base layer 210, the present invention also utilizes a lightweight cover layer 212.

The lightweight cover layer 212 shown in FIG. 2 may generally be a lightweight material with a density that is lower than the density of the base layer 210, sole 206, and the striking face 202. In one exemplary embodiment the layer of lightweight material 210 may be constructed using an aluminum material with a density of about 2.7 g/cm$^3$, a magnesium material with a density of about 1.738 g/cm$^3$, a composite type material with a density of about 1.50 g/cm$^3$, or any other material having a lower density than the density of the first material all without departing from the present invention. In a preferred embodiment of the present invention the material used to create lightweight cover layer 212 may generally be a composite material having a very low fiber areal mass. More information regarding composite materials with a low fiber areal mass in a golf club head may be found in U.S. patent application Ser. No. 14/834,654 by Deshmukh, the disclosure of which is incorporated by reference in its entirety.

The combination of the base layer 210 and the lightweight cover layer 212 allows the golf club head 200 to achieve the maximum amount of discretionary mass all while preserving the structural rigidity in the crown 204 portion to be able to endure the high impact stressed between a golf club 200 and a golf ball. The amount of discretionary mass saved from the crown 204 portion can then easily be applied to more strategic locations within a golf club head 200.

One exemplary location of this more strategic location of discretionary mass can also be seen in FIG. 2 in the form of a mass member 220. In the current exemplary embodiment of the present invention, the discretionary mass may be concentrated towards the rear sole portion of the golf club head 200, however the mass member 220 could be located at alternative locations within the golf club head 200 without departing from the scope and content of the present invention. In the current exemplary embodiment of the present invention the amount of additional mass located in the mass member may generally be greater than about 5 grams, more preferably greater than about 7 grams, and most preferably greater than about 9 grams without departing from the scope and content of the present invention.

Figure 3:
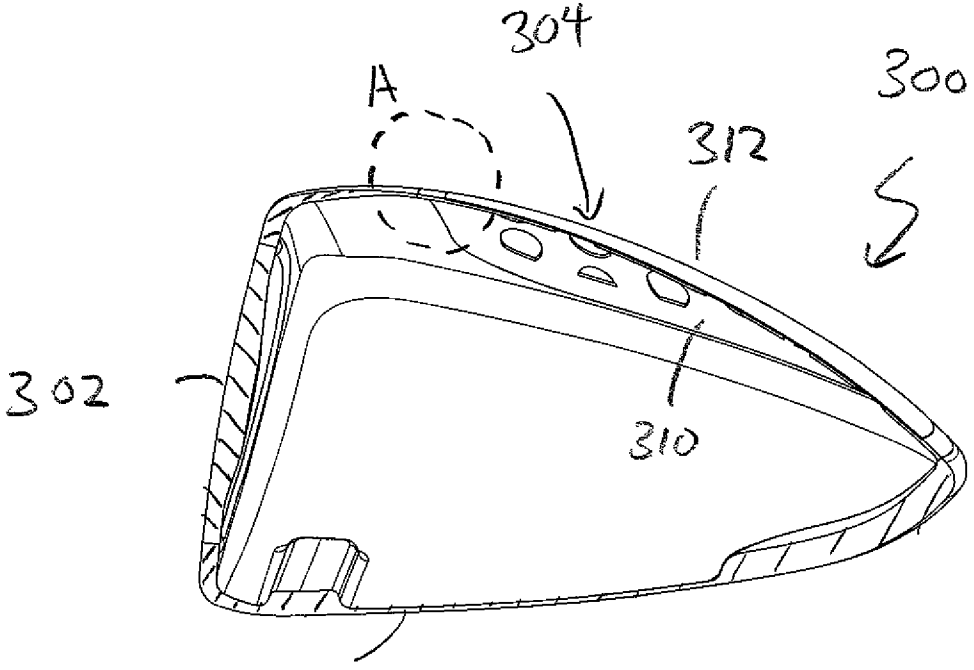
FIG. 3 of the accompanying drawings shows a cross-sectional view of the golf club head shown in FIG. 1, taken down the middle of the golf club head in a forward and aft orientation.

In order to illustrate how the various components interact with each other in an assembled setting, FIG. 3 of the accompanying drawing is provided illustrating a cross-sectional view of a golf club head 300. This cross-sectional area is taken along the center of the golf club head in a forward aft orientation, passing through the center of the striking face. In this cross-sectional view we can see that the golf club head 300 still has a striking face 302, a crown portion 304, and a sole portion 306. The crown portion 304, as previously illustrated in the exploded view shown in FIG. 2, may be further comprised out of a base layer 310 and a lightweight cover layer 312. First and foremost, it can be seen that the thickness of the crown portion 304 is extremely small, allowing the golf club head 300 to achieve the discretionary mass that is desired. Given how thin the entire thickness of the crown portion 304 is, it can be easily deduced that the lightweight cover 312 could be even thinner. In order to illustrate the thickness of the crown portion 304 together with the base layer 310 as well as the lightweight cover layer 312, FIG. 4 is provided, which focuses on an enlarged cross-sectional view of circular region A shown in FIG. 3.

Figure 4:
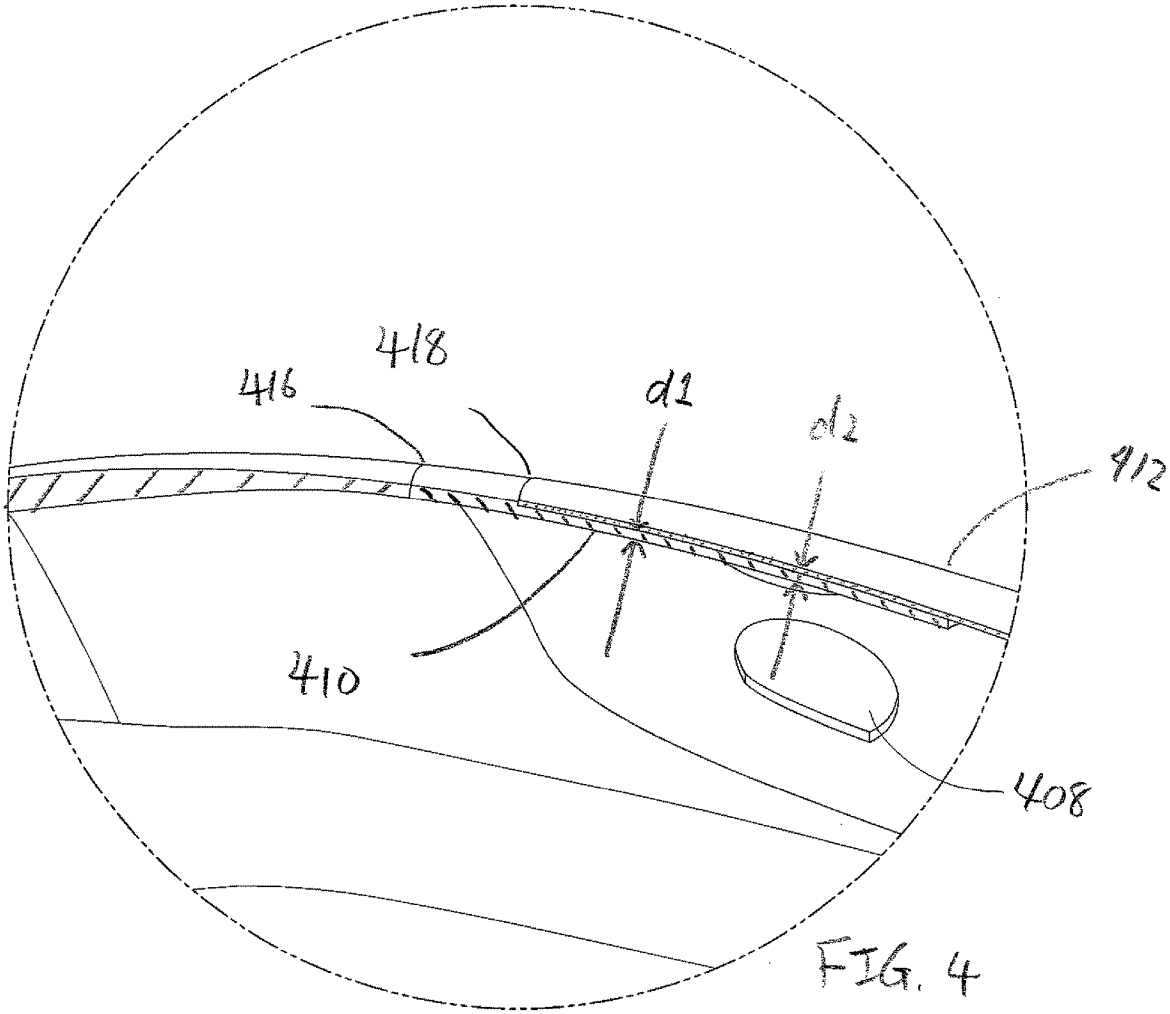
FIG. 4 of the accompanying drawings shows an enlarged cross-sectional view of a portion of a golf club head identified by circular region A shown in FIG. 3.

FIG. 4 of the accompanying drawings shows an enlarged cross-sectional view of a portion of a crown 304 of a golf club head 300 as illustrated by circular region A shown in FIG. 3. First and foremost, it should be noted that the base layer 410 shown in FIG. 4 may generally be attached to the frontal crown portion of the golf club head via a welding process, near welding joint 416. Since the base layer 410 and the frontal portion of the crown are both made out of a titanium type material, they may generally be welded together without any issues. Right behind the welding joint 416, it can be seen that the base layer 410 may have a step 418 to allow the lightweight cover layer 412 to be placed above the base layer 410. In one exemplary embodiment of the present invention, the lightweight cover layer 412 may be attached to the base layer 410 by using an adhesive type material. However, it should be noted that if a composite material is used, the lightweight cover layer 412 can be directly molded over the base layer 410 without departing from the scope and content of the present invention. In the current exemplary embodiment of the present invention, the base layer 410 may generally have a thickness d1 that is less than about 0.50 mm, more preferably less than about 0.40 mm, and most preferably less than about 0.35 mm, all without departing from the scope and content of the present invention. The lightweight cover layer 412 shown in this current exemplary embodiment of the present invention, due to the fact that is may be made out of a lightweight composite type material, may generally have a thickness d2 that is less than about 0.30 mm, more preferably less than about 0.25 mm, and most preferably less than about 0.20 mm.

It is worth noting here that although the above discussion focuses on the mass, thickness, and density of the different layers in order to reduce unnecessary mass and create discretionary mass, the crux of the current invention is based on the ability to achieve the mass savings without sacrificing the all-important sound and feel of the golf club head. Based on the discussion above one can clearly see that the material used for the lightweight cover layer, by the nature of having a lower density, can help reduce the mass of the golf club when it is used compared to standard titanium type material. However, the present invention recognizes that when lightweight material is used to replace traditional titanium materials, the sound and feel of the golf club head suffers. This degradation in the sound and feel of the golf club when lightweight material is used occurs because the acoustic vibration that occurs during impact with a golf ball will differ depending on the material.

The present invention not only recognizes the potential for degradation of sound, but also addresses this issue by finding the proper balance between the amount of mass saving achieved together with the preservation of the sound and feel of the golf club head. In order to achieve this harmonious balance, the present invention has found that by focusing on the amount of the lightweight cover layer 412 being exposed internally through the cutouts 408 of the base layer 410 will help preserve the acoustic signature and feel of the golf club head all while obtaining the discretionary mass desired. This amount of exposed lightweight cover layer 412 through the cutouts 408 is generally expressed as a percentage of the total internal surface area of the lightweight cover layer 412, and is extremely critical to the proper functionality of the present invention. More specifically, it can be said that in a preferred embodiment of the present invention, only between about 15% to about 60% of the internal surface area of the lightweight cover layer 412 is exposed internally through the cutouts 408, more preferably between about 20% to about 50%, and most preferably between about 25% to about 45%. The range of internal surface area exposed is critical to the proper functionality of the present invention because if too much of the lightweight cover layer 412 is exposed internally through the cutouts 408, the acoustic sound and feel of the golf club suffers. Alternatively, if too little of the internal surface area of the lightweight cover layer 412 is exposed through the cutouts 408, then the mass savings does not become significant enough to achieve any mass savings.

In order to quantify this very important percentage, the present invention has created a very simplistic term called the "Internal Exposure Percentage", defined as the internal surface area of the lightweight cover layer 412 that is exposed through the cutouts 408 divided by the total internal surface area of the lightweight cover layer 412. This "Internal Exposure Percentage" is summarized by Equation (1) below:

$$\text{Internal Exposure Percentage} = \text{Internal Surface Area Exposed through Cutouts}/\text{Total Internal Surface Area} \quad \text{Eq. (1)}$$

As described above, the Internal Exposure Percentage of a lightweight cover layer 412 for a golf club head in accordance with the present invention is most preferably between about 15% to about 60%, more preferably between about 20% to about 50%, and most preferably between about 25% to about 45%.

Figure 5:
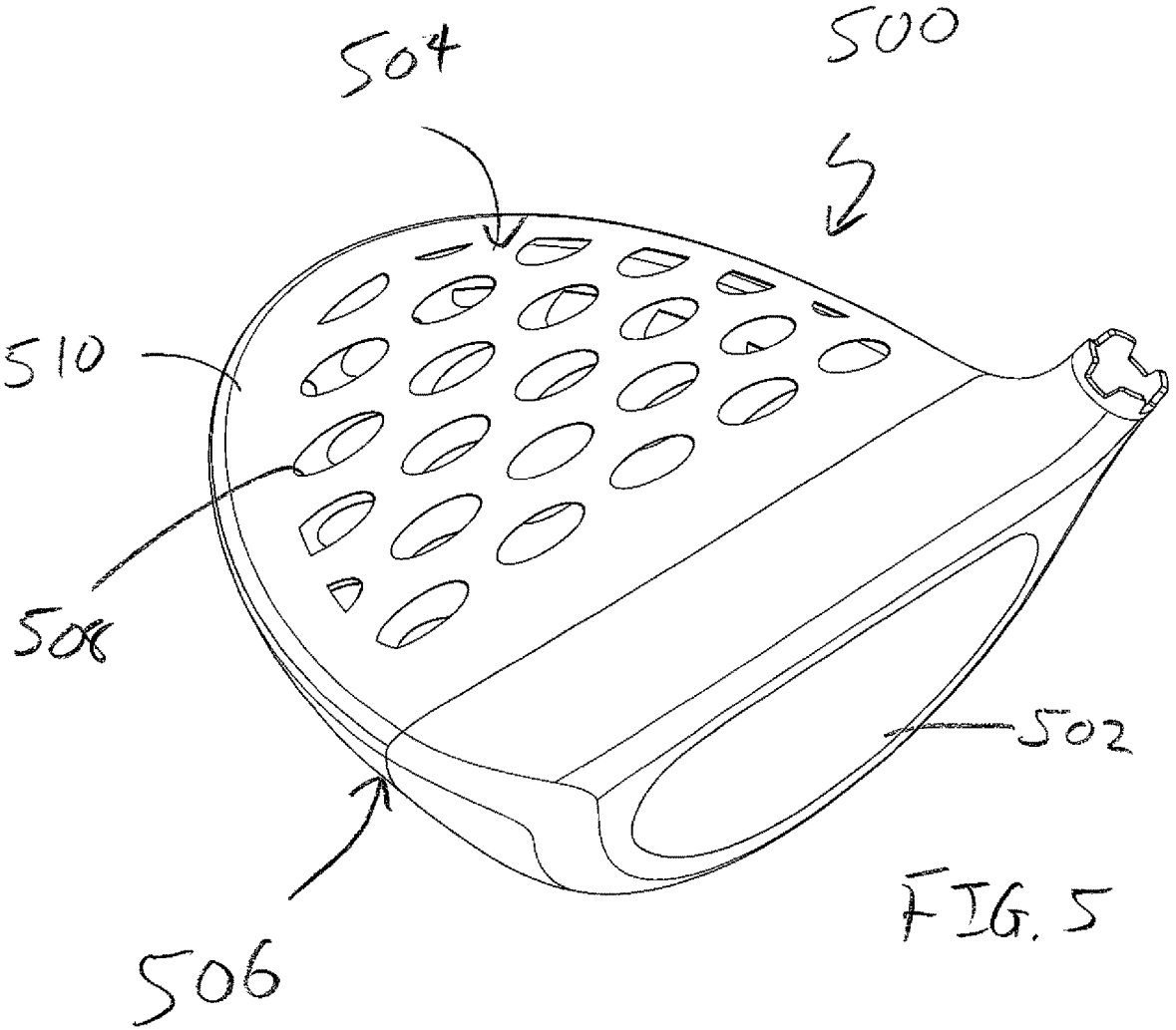
FIG. 5 of the accompanying drawings shows a perspective view of a golf club head in accordance with an alternative embodiment of the present invention.

FIG. 5 of the accompanying drawings shows a perspective view of a golf club head 500 in accordance with an alternative embodiment of the present invention. In this embodiment of the present invention, the base layer 510 may not be limited to the crown portion 504 of the golf club head 500, but could be applied towards the sole portion 506 of the golf club head 500 without departing from the scope and content of the present invention. In order to provide a more clear illustration of the various components of the golf club head 500, FIG. 6 providing an exploded view is also provided.

Figure 6:
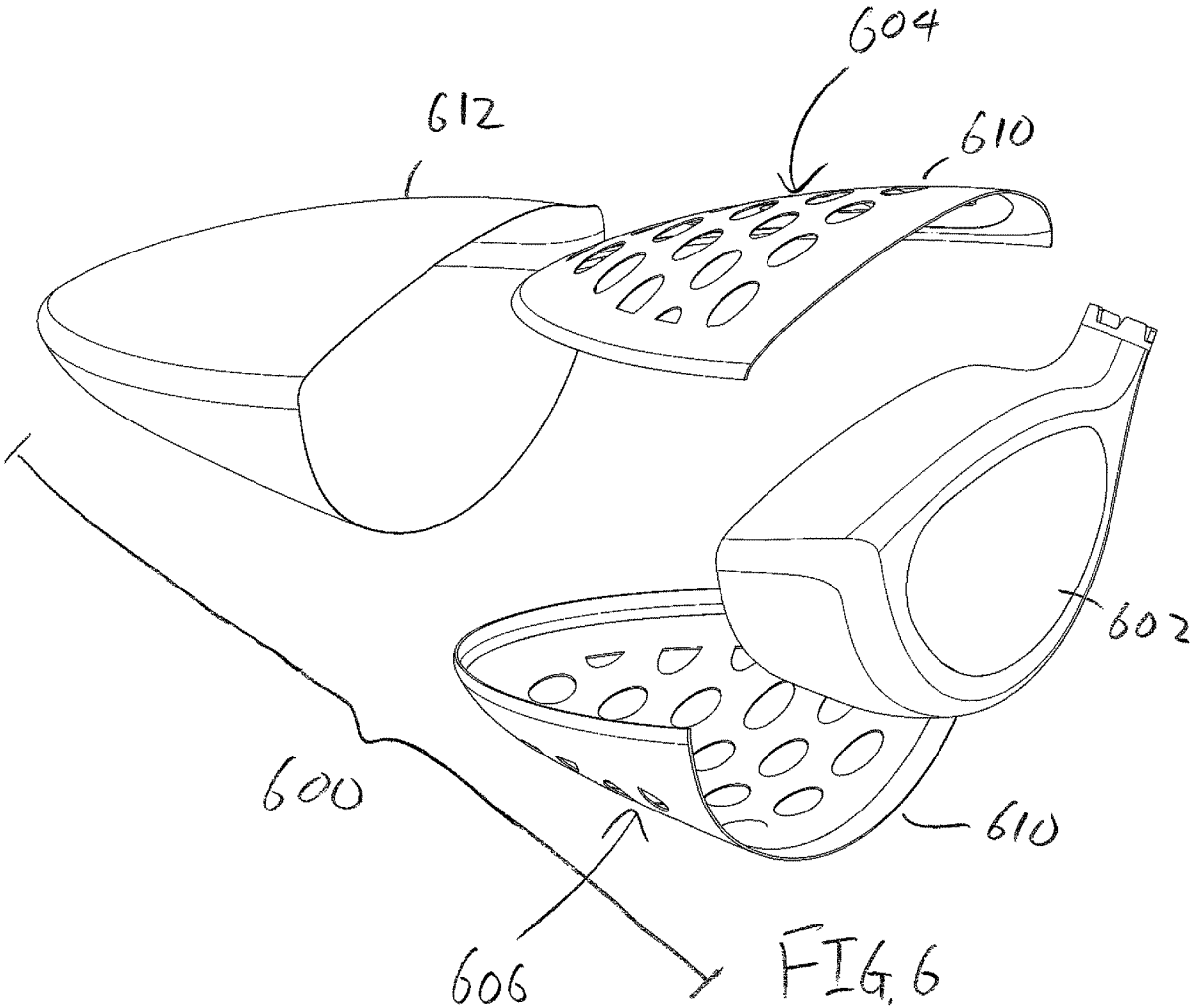
FIG. 6 of the accompanying drawings shows an exploded perspective view of a golf club head in accordance with the alternative embodiment of the present invention shown in FIG. 5.

FIG. 6 of the accompanying drawings shows an exploded perspective views of a golf club head 600 in accordance with the alternative embodiment of the present invention shown in FIG. 5. In this exploded view of the present invention, it can be seen that the sole 606 portion of the golf club head 600 may also contain a base layer 610 in addition its utilization in the crown 604 portion. In addition to the above, FIG. 6 also illustrates the shape and dimension of the lightweight cover layer 612, which was previously removed from FIG. 5 to illustrate the cutouts 508. The cover layer 612 does not need to be substantially planar as shown originally in FIG. 2, but rather could take on the external shape of a golf club head like a skin without departing from the scope and content of the present invention. It should be noted here that although the base layer 610 covers more of the golf club head, the percentage of internally exposed lightweight cover layer 612 is maintained to preserve the perfect balance between mass savings and preservation of sound and feel.

Figure 7:
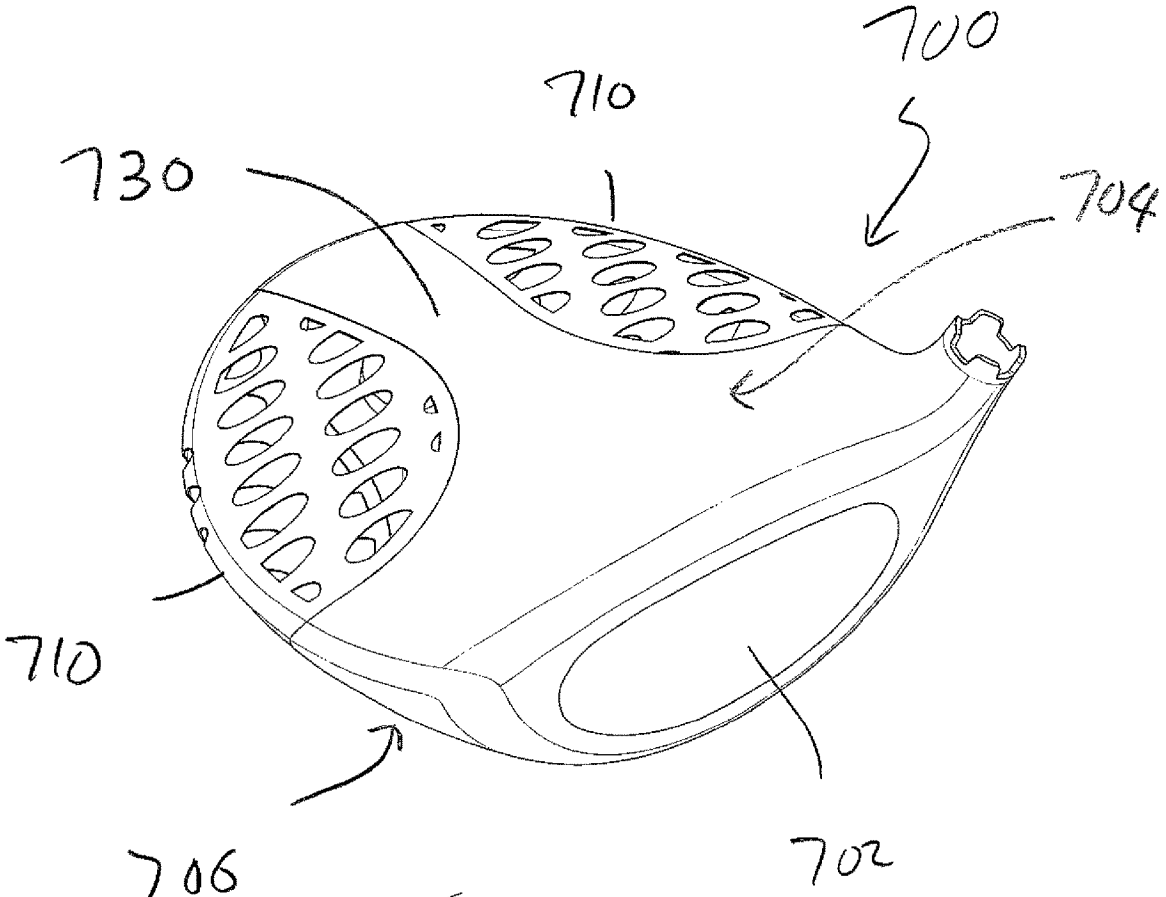
FIG. 7 of the accompanying drawings shows a perspective view of a golf club head in accordance with a further alternative embodiment of the present invention.

FIG. 7 of the accompanying drawings shows another perspective view of a golf club head 700 in accordance with a further alternative embodiment of the present invention. More specifically, in this alternative embodiment of the present invention the base layer 710 may be used at the toe and heel portion of the body of the golf club head 700 allowing the central portion of the golf club head 700 to create a bridge member 730 without departing from the scope and content of the present invention. The bridge member 730, as shown in this exemplary embodiment of the present invention, may generally help create more structural rigidity within the golf club head 700, allowing the base layer 710 to be even thinner in some instances.

Figure 8:
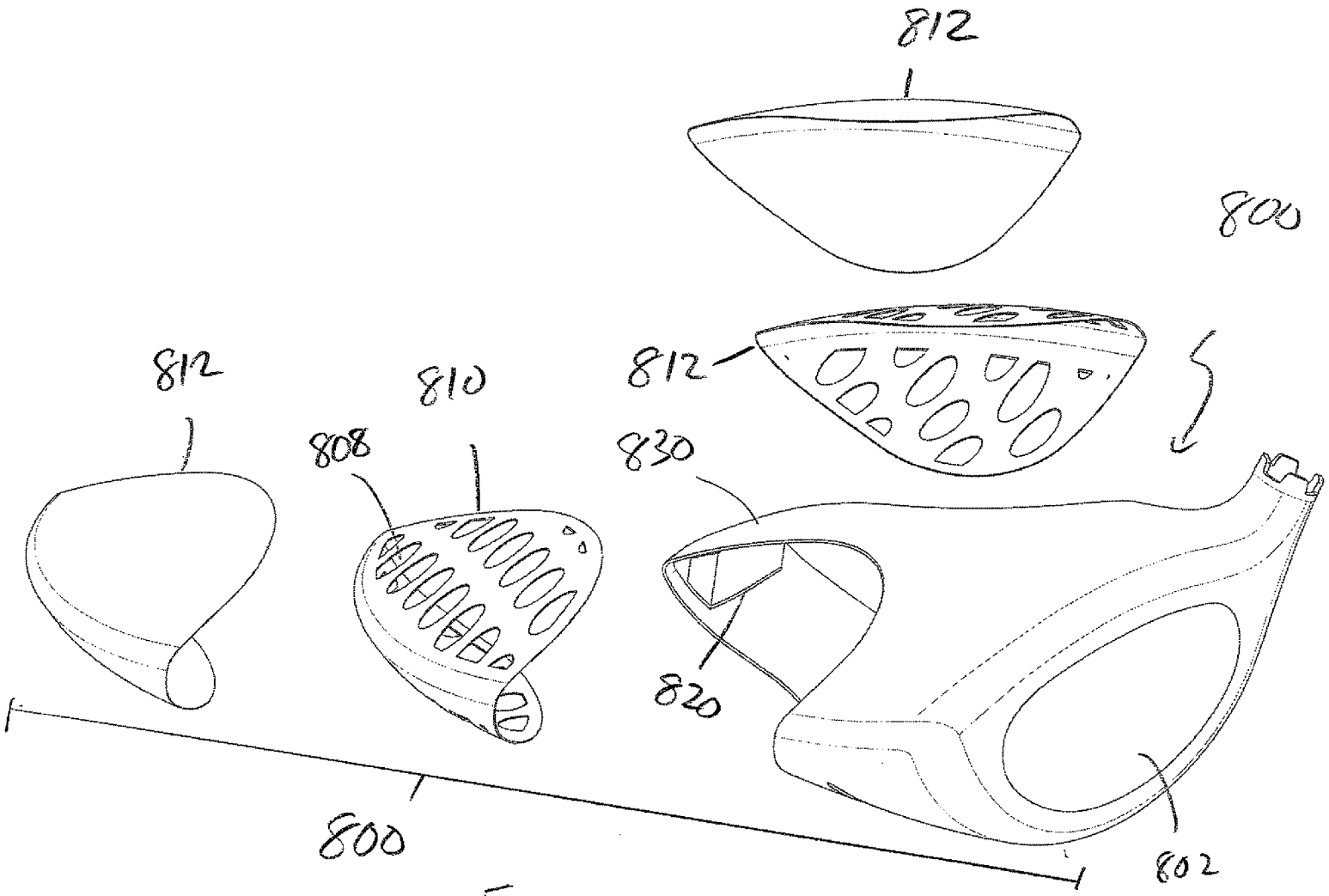
FIG. 8 of the accompanying drawings shows an exploded perspective view of a golf club head in accordance with the further alternative embodiment of the present invention shown in FIG. 7.

FIG. 8 of the accompanying drawings shows an exploded perspective view of the golf club head 800 shown in FIG. 7. This exploded perspective view not only allows the lightweight cover layer 812 to be shown more clearly, but also illustrates the mass member 820 located at the rear portion of the golf club head 800. It can be seen in this exploded perspective view that the mass member 820 is located along the bridge member 830 to allow the mass member 820 to be secured to the golf club head 800 without any need for additional features. Finally, it is worth noting that even in this alternative embodiment of the present invention, the golf club head will have the same percentage of internally exposed lightweight cover layer 812 through the cutouts 808 as previously discussed in order to preserve the perfect balance between mass savings and the preservation of sound and feel.

Figure 9:
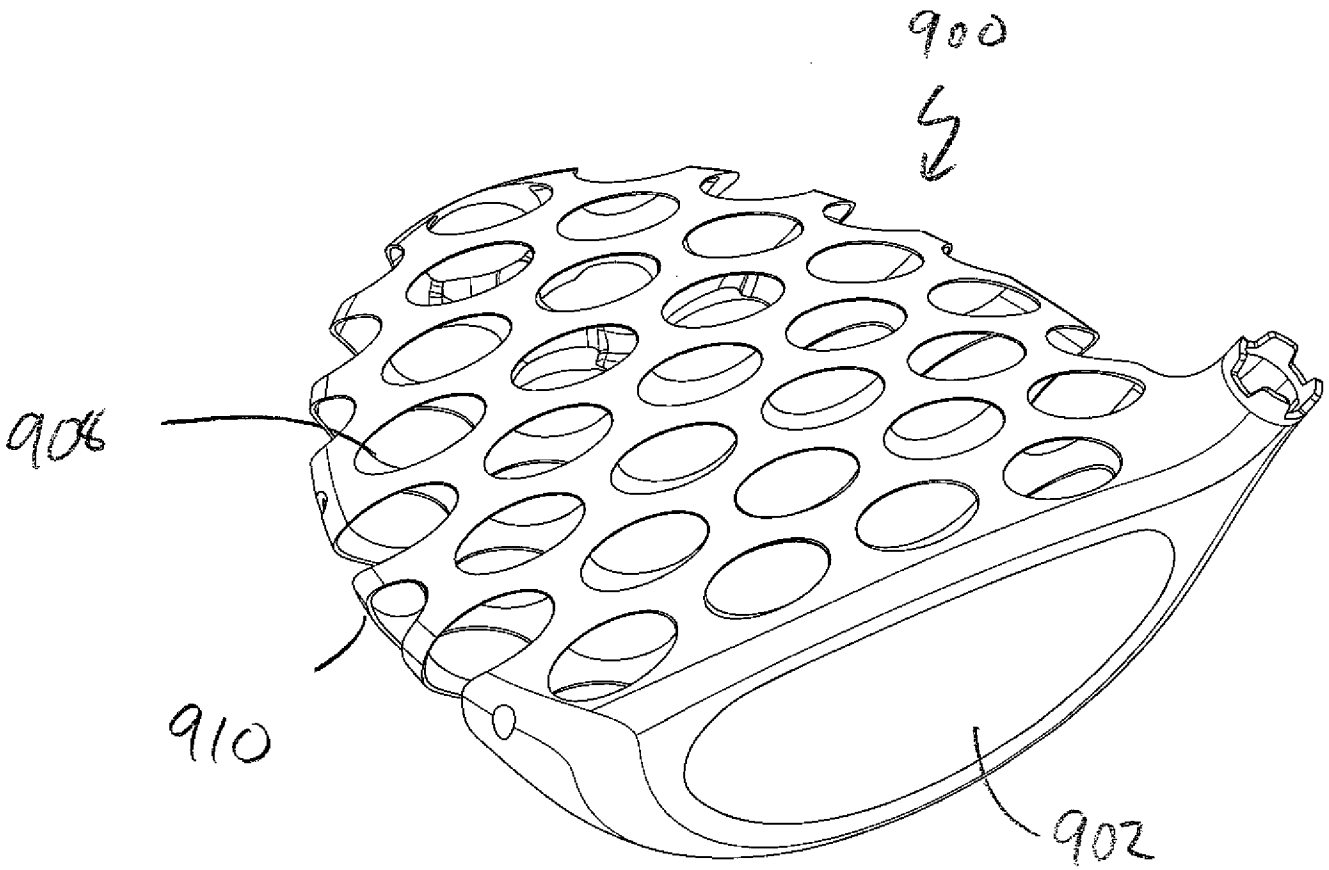
FIG. 9 of the accompanying drawings shows a perspective view of a golf club head in accordance with an even further alternative embodiment of the present invention.

FIG. 9 of the accompanying drawings shows a perspective view of a golf club head 900 in accordance with a further alternative embodiment of the present invention. In this alternative embodiment of the present invention the golf club head 900 could incorporate the plurality of cutouts 908 through the entire body portion to create the base layer 910. This golf club head 900 may generally be covered with a lightweight cover layer as previously discussed in prior embodiments, but the cover layer is not shown in FIG. 9 to allow more clarity of the internal structure.

Figure 10:
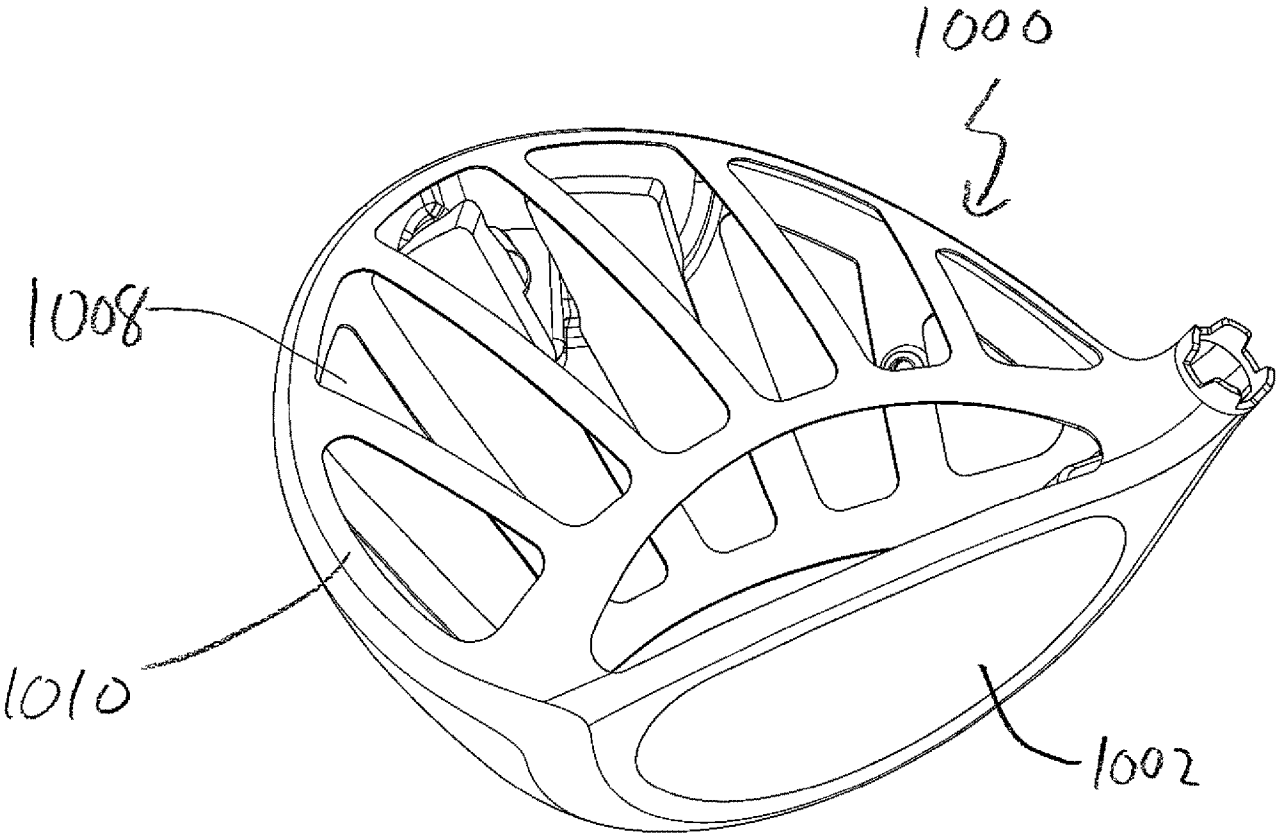
FIG. 10 of the accompanying drawings shows a perspective view of a golf club head in accordance with another further alternative embodiment of the present invention.

FIG. 10 of the accompanying drawings shows a perspective view of a golf club head 1000 in accordance with a further alternative embodiment of the present invention. FIG. 10 shows a slightly different internal structure wherein the base layer 1010 may be created using cutouts 1008 that is not circular in shape. In fact, in alternative embodiments of the present invention the cutouts 1008 may take on any shape that is circular, oval, rectangular, or any other shape all without departing from the scope and content of the present invention so long as it has an internal exposure percentage in accordance with the discussion above.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion located at a frontal portion of said golf club head; and a body portion attached to an aft portion of said striking face portion further comprising a crown portion and a sole portion;

wherein at least one of said crown portion and said sole portion further comprises a base layer and a lightweight cover layer;

said base layer further comprises a plurality of cutouts, and said lightweight cover layer has an Internal Exposure Percentage of between about 25% to about 45%.

2. The golf club head of claim 1, wherein said lightweight cover layer is made out of a material with a density of less than about 2.7 g/cm$^3$.

3. The golf club head of claim 2, wherein said lightweight cover layer is made out of a material with a density of less than about 1.75 g/cm$^3$.

4. The golf club head of claim 3, wherein said lightweight cover layer is made out of a material with a density of less than about 1.50 g/cm$^3$.

5. The golf club head of claim 4, wherein said lightweight cover layer is made out of a composite material.

6. The golf club head of claim 5, wherein said base layer is made out of a material with a density of between about 4.0 g/cm$^3$ and about 4.7 g/cm$^3$.

7. The golf club head of claim 6, wherein said base layer is made out of a material with a density of between about 4.1 g/cm$^3$ and about 4.6 g/cm$^3$.

8. The golf club head of claim 7, wherein said base layer is made out of titanium material.

9. The golf club head of claim 8, wherein said base layer has a maximum thickness of less than about 0.50 mm, and said lightweight cover layer has a maximum thickness of less than about 0.30 mm.

10. The golf club head of claim 9, wherein said base layer has a maximum thickness of less than about 0.40 mm, and said lightweight cover layer has a maximum thickness of less than about 0.25 mm.

11. The golf club head of claim 10, wherein said base layer has a maximum thickness of less than about 0.35 mm, and said lightweight cover layer has a maximum thickness of less than about 0.20 mm.

12. A golf club head comprising:

a striking face portion located at a frontal portion of said golf club head; and a body portion attached to an aft portion of said striking face portion further comprising a crown portion and a sole portion;

wherein at least one of said crown portion and said sole portion further comprises a base layer and a lightweight cover layer;

said base layer further comprises a plurality of cutouts, and said lightweight cover layer has an Internal Exposure Percentage of between about 25% to about 45%, and wherein said base layer has a maximum thickness of less than about 0.50 mm, and said lightweight cover layer has a maximum thickness of less than about 0.30 mm.

13. The golf club head of claim 12, wherein said plurality of cutouts is substantially circular in shape.

14. The golf club head of claim 12, wherein only said crown portion further comprises said base layer and a lightweight cover layer.

15. The golf club head of claim 12, wherein both said crown portion and said sole portion further comprises a base layer and said lightweight cover layer.

16. The golf club head of claim 12, wherein said body portion further comprises a bridge member, attached to a central portion rearward of said striking face portion, separating a sole side and a heel side of said golf club head.

17. The golf club head of claim 12, wherein said base layer is made out of a material with a density of between about 4.1 $g/cm^3$ and about 4.6 $g/cm^3$.

18. The golf club head of claim 17, wherein said lightweight cover layer is made out of a material with a density of less than about 1.70 $g/cm^3$.

* * * * *